US005566422A

United States Patent [19]

Geyer

[11] Patent Number: 5,566,422

[45] Date of Patent: Oct. 22, 1996

[54] TANK CONFIGURATION FOR A SMALL FLOOR SCRUBBER

[75] Inventor: Robert A. Geyer, Champlin, Minn.

[73] Assignee: Tennant Company, Minneapolis, Minn.

[21] Appl. No.: 372,506

[22] Filed: Jan. 13, 1995

[51] Int. Cl.[6] ..... A47L 7/00; A47L 11/30

[52] U.S. Cl. ..... 15/320; 15/353

[58] Field of Search ..... 15/320, 347, 353

[56] References Cited

U.S. PATENT DOCUMENTS

| | | | |
|---|---|---|---|
| 2,635,277 | 4/1953 | Belknap | 15/353 |
| 2,635,278 | 4/1953 | Belknap | 15/320 |
| 2,726,807 | 12/1955 | Lewis | 15/320 |
| 3,402,420 | 9/1968 | Schaeffer | 15/320 |
| 4,233,706 | 11/1980 | Kauffeldt | 15/353 |
| 4,287,635 | 9/1981 | Jacobs | 15/353 |
| 4,314,385 | 2/1982 | Wimsatt | 15/353 |
| 4,393,538 | 7/1983 | Olson | 15/320 |
| 4,464,810 | 8/1984 | Karpanty | 15/320 |
| 4,483,041 | 11/1984 | Waldhauser | 15/320 |

FOREIGN PATENT DOCUMENTS

| | | | |
|---|---|---|---|
| 1100266 | 1/1968 | United Kingdom | 15/320 |

*Primary Examiner*—David Scherbel

*Assistant Examiner*—Randall E. Chin

*Attorney, Agent, or Firm*—Dorn, McEachran, Jambor & Keating

[57] ABSTRACT

A small floor scrubbing machine is powered by a centrally located battery pack, with a recovery tank for used scrubbing solution comprised of connected chambers located on four sides of and beneath the batteries, and a tank for clean solution in a lid over the recovery tank and batteries. A partial partition in the chamber behind the batteries effectively divides it into two chambers. A vacuum fan draws air and used solution into one rear chamber of the recovery tank and exhausts air to atmosphere from the other rear chamber. The extended airflow path from one rear chamber to the other around three sides of the battery pack allows mist and foam to settle out of the air stream before it reaches the vacuum fan inlet. The front and rear chambers provide plenum space to reduce the airflow velocity. Openings in the partition between the rear tanks bypass increasing amounts of air directly from one rear chamber to the other as the recovery tank fills with water, thus compensating for the diminishing airflow space above the water and controlling the velocity of the airflow. The arrangement provides improved foam control in the limited space available in a small scrubber, a constant center of gravity as the solution tank empties and the recovery tank fills during normal operation, and easy access to the recovery tank for cleaning.

13 Claims, 6 Drawing Sheets

Fig. 2.
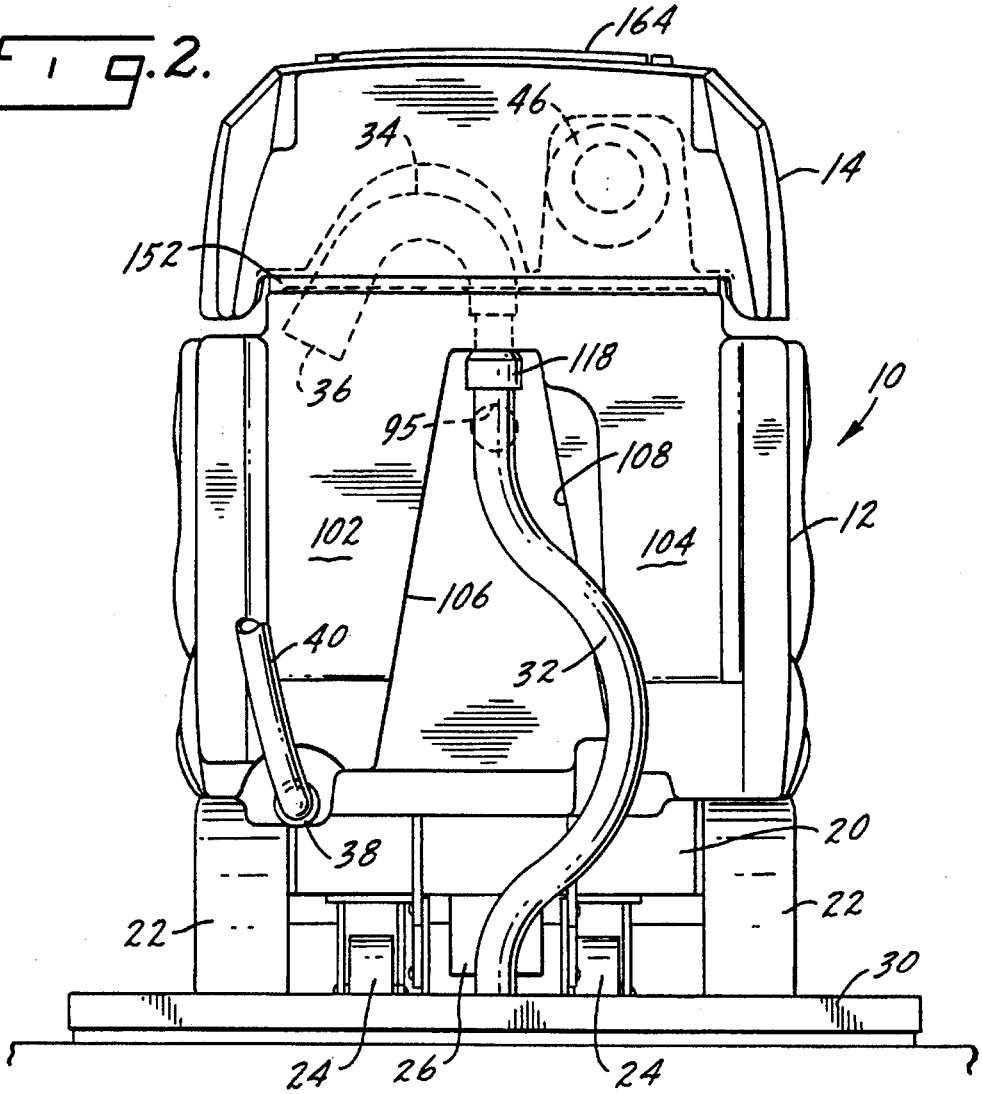
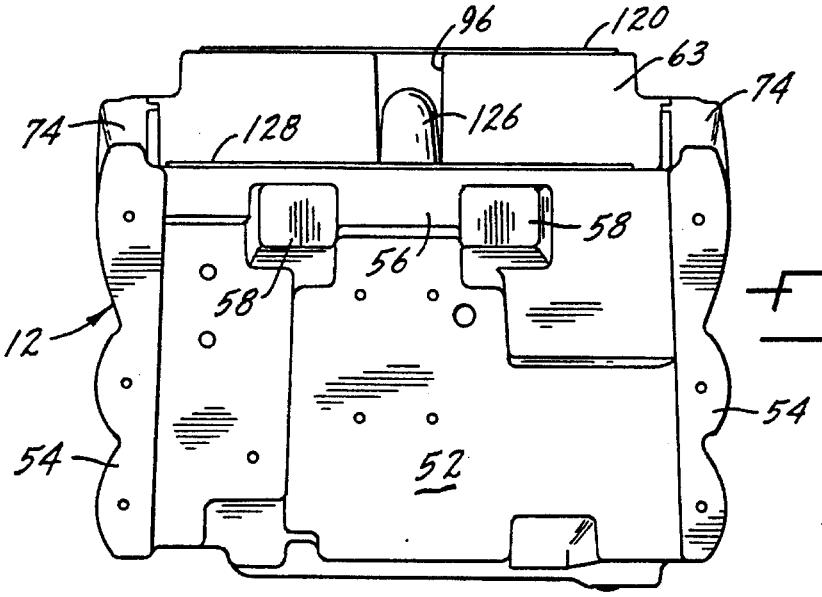
Fig. 3.

14
16
15
14
11
10
9
12
132
130
134
133
135
174
172
162
166
168
140
146
150
148
142
144

138
136
164
160
154
156
152
151

Fig. 11.
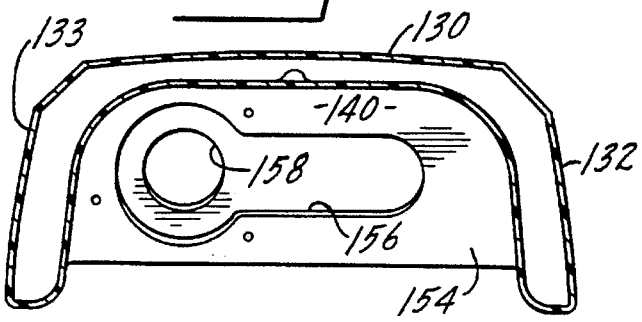
Fig. 12.
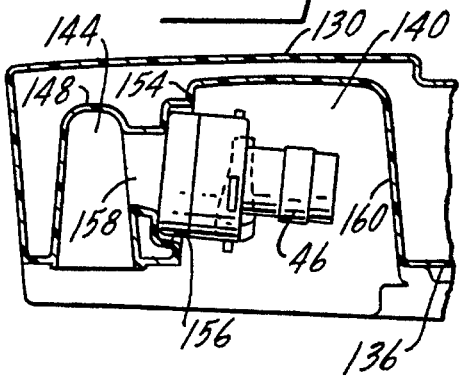
Fig. 14.
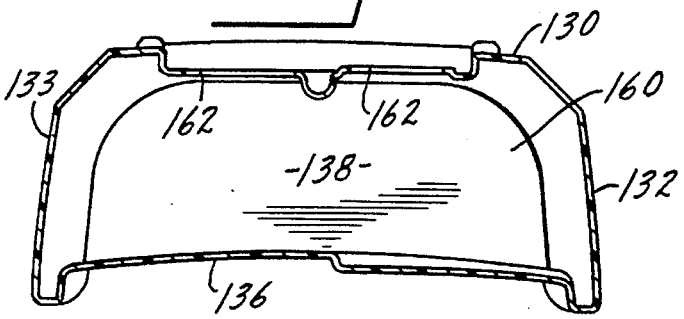
Fig. 13.
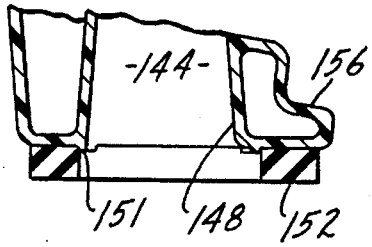
Fig. 15.
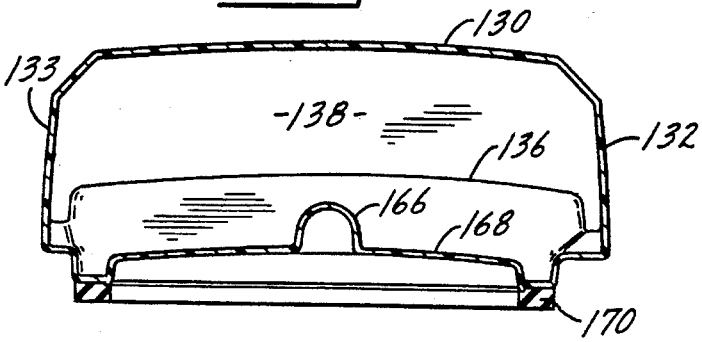
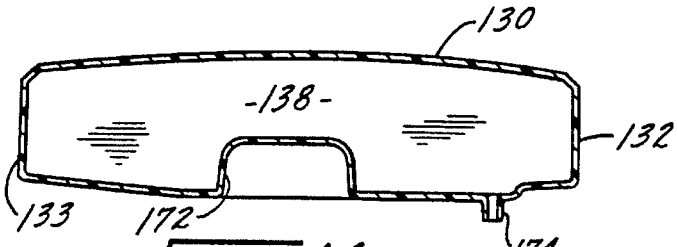
Fig. 16.

TANK CONFIGURATION FOR A SMALL FLOOR SCRUBBER

BACKGROUND OF THE INVENTION

Floor scrubbing machines are widely used to clean the floors of industrial and commercial buildings. They range in size from a small model which may clean a path ranging from perhaps 15 inches up to 36 inches wide controlled by an operator walking behind it, tio a large model cleaning a path as wide as five feet controlled by an operator riding on the machine. Such machines in general are wheeled vehicles with suitable operator controls. Their bodies contain power and drive means, a solution tank to hold clean scrubbing solution and a recovery tank to hold soiled solution recovered from the floor being scrubbed. A scrub head which contains One or more scrubbing brushes and means to drive them are attached to the vehicle by a jointed linkage system, and may be located in front of, under or behind it. A water distribution system dispenses scrubbing solution from the clean water tank to the floor in the vicinity of the scrubbing brush or brushes and there is a system to recover soiled scrubbing solution from the floor after it has been scrubbed. Solution recovery is the primary area with which this patent is concerned. Other areas of concern will also be described later.

In general, the solution recovery system comprises a double lipped vacuumized squeegee that wipes the floor behind the scrub head and collects the soiled scrubbing solution, which is comprised of water, detergent and soilage that has been loosened from the floor. A flexible hose and rigid ducting as needed connect the squeegee to the upper part of the recovery tank in the body of the vehicle where the soiled solution is stored. A high volume vacuum fan pulls air from the top of the recovery tank and exhausts it to atmosphere, which creates a sub-atmospheric pressure in the tank that draws air through the ductwork from the squeegee. The air velocity is high enough at the squeegee that the soiled scrubbing solution is entrained in the air stream and carried to the recovery tank. There the air spreads out, thus losing velocity, so that the solution drops into the tank while the air is exhausted to atmosphere by the fan.

It is important that only clean air passes through the fan. Soilage, water and detergent mixed with the air cause blade abrasion and bearing damage in the fan and cause it to blow out unacceptable pollution into the surrounding atmosphere. Therefore the soiled scrubbing solution must be completely separated from the air stream before the air reaches the fan.

Achieving this has been a long-standing challenge in scrubber design. The high air velocity needed for good water pickup in a vacuum squeegee together with turbulence of the conveying air stream in the ducts may break down some of the conveyed solution into a mist which can remain airborne and be drawn into the fan. Also, many detergents used in floor cleaning generate foam when they are agitated, and can produce enough foam on the surface of the water in the recovery tank to reach the fan inlet and blow through it before the recovery tank is full. Foam can also come from the soilage that is scrubbed from industrial or commercial plant floors, which will sometimes contain high foaming agents. A recovery tank is normally sized to recover the contents of the solution tank after application to the floor and also provide an air plenum space, but excessive foam can necessitate shutting down the machine and emptying the recovery tank before the solution tank is empty, which reduces the productivity of the machine.

Prior art has addressed the problem. U.S. Pat. No. 4,393,538 describes a four way approach comprising a gradually enlarging duct from the squeegee hose to the recovery tank to slow the air stream velocity with a minimum of agitation, a direction reversing baffle in the recovery tank, a filter ahead of the fan inlet, and a clean water mist sprayed on the foam to break it down. The air plenum space above the liquid in the recovery tank is recommended to be of sufficient volume that the air in it will change not more than 60 times per minute, with fewer changes preferred.

Such measures have proven to be quite effective in the larger sizes of scrubbers such as shown in the illustrations of the '538 patent. Large scrubbers provide sufficient height to accommodate an expanding air duct of effective length going up from their squeegee hoses to their recovery tanks, and their recovery tanks are large enough to provide adequate space between the air entry from the squeegee duct and the air exit into the fan inlet.

Small scrubbers, such as the common walk-behind models, lack these advantages. Scrubber squeegees commonly must swing from side to side to track the water path from the brushes in turns, so a flexible suction hose is needed going up from the squeegee. The height of a large machine accommodates a flexible hose of adequate length and above it a rigid duct which may have an expanding cross section. A small walk behind machine typically turns sharper than a large machine, so its squeegee must swing farther and will need a longer flexible hose. But the small machine has much less height. Typically the required length of flexible hose reaches nearly to the top of the machine and connects directly to the upper part of the recovery tank. This leaves no space for an expanding duct between the squeegee hose and the recovery tank as described in the '538 patent. Yet a small machine requires as much air velocity for water pickup as a large machine and has the same need for slowing down that air velocity to avoid foaming.

Also, as one might expect, the recovery tank used on a small machine is reduced in size to match the scale of the machine. On prior art small scrubbers the fan is typically set directly above the recovery tank, which together with the smaller tank has made a far shorter distance inside the tank from the squeegee hose outlet to the fan inlet than the large machines have. Thus they have had less settling of foam and mist before the air reached the fan.

From the above it can be seen that other means than those described in the prior art are needed to settle water out of the air stream and control foam in small walk-behind scrubbers.

SUMMARY OF THE INVENTION

The present invention recognizes the space limitations of a small scrubber and adapts the space that is available to combat the foaming problem. The battery pack which powers the machine is placed in the center of the scrubber body. The recovery tank is configured to go around the front, back, both sides and below the batteries. The side chambers of this tank, which have closed tops, are quite narrow, but connect to the bottom chamber and to a substantial open topped front chamber and two side by side rear chambers. A hinged lid is fitted over the body and contains the solution tank and the vacuum fan. The portions of the lid over the front and rear recovery chambers are fitted with gaskets which seal these chambers, and the vacuum fan is mounted in the lid with its inlet opening within the section which covers one of the rear recovery chambers. The chambers in front of and behind the batteries have open tops for ease of cleaning when the lid is raised, but are sealed by the lid during operation.

The squeegee hose discharges into the top of the rear recovery chamber that is not accessed by the fan and near one side of the machine. An end portion of the hose is bent nearly 180 degrees and has an expanding section leading to its open end to provide a direction reversing baffle and gradual reduction of the air velocity. It would also be possible to provide these functions with a similar passageway molded into the lid. The fan pulls its air from the other rear recovery chamber near the other side of the machine and exhausts it to atmosphere through space provided between the lid and the scrubber body. The shrouding around the squeegee hose creates the partition between the two rear chambers, but it is a partial partition which leaves a limited air passageway between them. As the recovery tank starts to fill with water, 80% or more of the airflow travels from the squeegee hose outlet into the rear chamber where the squeegee hose outlet is located, through the side chamber nearest to it, through the front chamber, through the other side chamber and into the other rear cheer to the fan inlet because this is the path of least resistance. In effect the air travels around the battery pack. Up to perhaps 20% of the air travels through the limited passageway between the two rear chambers. As the recovery tank fills with water and the air space above it diminishes, up to 15% of the airflow travels through the passageway between the rear tanks. This keeps the velocity of the air from increasing so that it doesn't start carrying foam with it. The limited air passageway between the rear tanks thus becomes a controlling bypass to maintain a reduced air velocity in the recovery tank as it fills.

The recovery tank is necessarily limited in depth by the size of the machine, but forming it of several connected chambers provides enough volume for the necessary storage of soiled scrubbing solution, and an adequate air plenum is provided so that 60 air changes per minute as recommended by the '538 patent can be obtained. The expansion space provided by the three recovery tank chambers reduces the air velocity enough to control foaming. The airflow travels horizontally for an extended distance around the connected chambers of the recovery tank so the entrained water and mist settle out by gravity.

The recovery tank configuration of the present invention locates the squeegee hose outlet and the fan inlet at least as far apart in terms of airflow path as they are in large scrubbers and provides a major improvement over the prior art small machines which typically mount the fan above the recovery tank in close proximity to the squeegee hose outlet. The arrangement of the connected chambers provides four direction changes for the airflow between the squeegee hose and the fan, and these assist in separating water and mist out of the air stream. Prior art designs may provide one or two.

The total effect is that a small floor scrubbing machine is provided with foam control comparable to that which has previously been available only in larger models of scrubbers.

Several other benefits are also obtained by the present invention. Arranging the recovery tank around the battery pack and placing the solution tank above them causes the fore and aft center of gravity of the machine to remain essentially constant as the solution tank empties and the recovery tank fills, which improves traction and handling. Also, the front and rear recovery tank chambers are easily accessible for cleaning because their tops are open when the lid is raised, and a hose nozzle inserted down into the front chamber can readily flush sludge out of the side and bottom chambers into the rear chambers, which have a drain. While cleaning the recovery tank the vacuum fan is protected from spray because it is swung up out of the way.

BRIEF DESCRIPTION OF THE DRAWINGS

FIG. 2 is a rear elevation view of the scrubber.

FIG. 3 is a front elevation view of the recovery tank.

FIG. 11 is a section taken along line 11—11 of FIG. 8.

FIG. 12 is a section taken along line 12—12 of FIG. 8.

FIG. 13 is an enlarged detail view of a sealing bead around the extension chambers.

FIG. 14 is a section taken along line 14—14 of FIG. 8.

FIG. 15 iS a section taken along line 15—15 of FIG. 8.

FIG. 16 is a section taken along line 16—16 of FIG. 8.

DETAILED DESCRIPTION OF THE INVENTION

Figure 1:
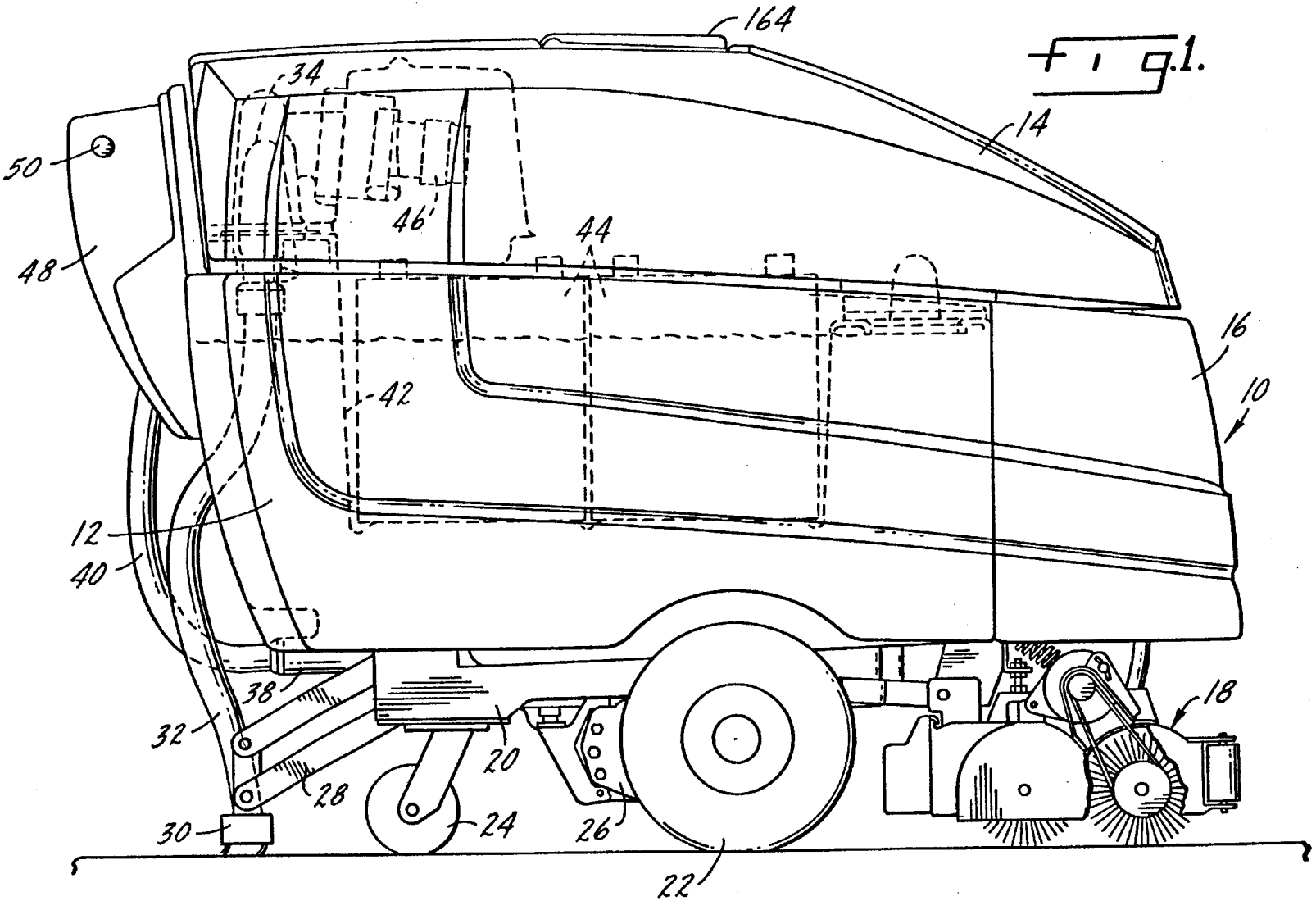
FIG. 1 is a side elevation view of the scrubber of the present invention.

FIGS. 1 and 2 illustrate the scrubber 10 of the present invention. The scrubber has a body comprising a recovery tank 12, a lid 14 and a front cover 16. The lid is attached along one side of the recovery tank by hinges (not shown) so the lid can be pivoted up to provide access to the interior of the tank 12. The front cover 16 is removably attached to the front of the recovery tank above a scrub head 18. The scrub head includes the usual equipment for cleaning a floor, such as brushes, shrouds, brush drives and appropriate plumbing for applying a cleaning solution. The scrub head is attached to the front of the recovery tank and to a frame 20 such that the scrub head can be moved between a lowered working position and a raised traveling position.

The frame 20 supports the recovery tank 12 on wheels 22 and casters 24. The frame is preferably made of glass reinforced plastic such that it is torsionally flexible. Further details of the frame are shown and described in U.S. patent application entitled "Torsionally Flexible Frame Structure", invented by Michael L. Blehert and Robert A. Geyer, Ser. No. 08/372,512, filed on Jan. 13, 1995, now pending and assigned to the present assignee, the disclosure of which is incorporated herein by reference. Wheels 22 are preferably driven by a motor and transaxle assembly shown schematically at 26. The rear of the frame carries a linkage 28 to which a vacuum squeegee 30 is attached. The squeegee is in fluid communication with an inlet chamber in the recovery tank through a hose 32 and inlet duct 34. The inlet duct 34 flares toward its open end 36 (FIG. 2) to assist in reducing the velocity of air and liquid entering the inlet chamber. The bottom of the inlet chamber is provided with a drain 38 with a driain hose 40 connected to it.

The vehicle body incorporates a battery compartment 42 in which batteries 44 reside. The batteries provide power to the drive motor 26, scrub head 18, and a vacuum fan 46. The vacuum fan 46 is mounted in the lid 14. A control unit 48 (FIG. 1) mounted on the rear of the body includes steering control handles 50 and the necessary operating controls and gauges for the scrubber.

FIG. 3 illustrates details of the front of the recovery tank 12. The tank has a front exterior wall 52 bounded by vertical shoulders 54 and a horizontal ledge 56, both of which extend forwardly of the wall 52. The shoulders 54 provide a mounting surface for the front cover 16. A pair of extensions 58 extend from the ledge for receiving a bracket (not shown) on which various portions of the cleaning solution plumbing are mounted.

The recovery tank 12 is shown in detail in FIGS. 4–7. The major structural components of the tank include interior front and rear walls 62, 63, interior left and right side walls 64, 65 and an interior bottom wall 66. These walls 62–66 define the battery compartment 42. The battery compartment is surrounded on five sides by an exterior bottom wall 68, exterior left and right sidewalls 70, 71, the exterior front wall 52 and a rear section 72. Top wall 74 joins the upper edges of the interior and exterior walls. Together the interior, exterior and top walls define a plurality of connected chambers or compartments. These chambers include an inlet chamber 76, a bottom chamber 78, left and right side chambers 80, 82, a front expansion chamber 84 and an exit chamber 86. A bypass or passage 87 connects the inlet chamber 76 and exit chamber 86. The left, right, front and bottom chambers are between the inlet and exit chambers, in terms of the major air flow path of the recovery tank, and can thus be termed intermediate chambers. The recovery tank chambers in front of and to the rear of the batteries are larger than the recovery tank chambers at the sides of the batteries.

Figure 6:
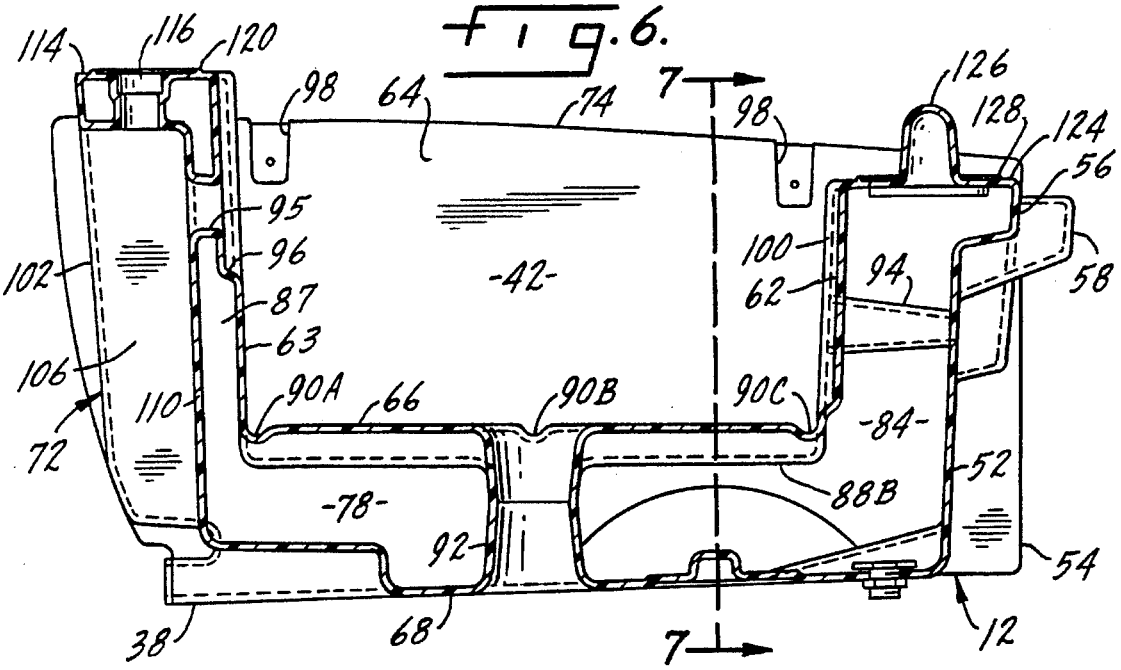
FIG. 6 is a section taken along line 6—6 of FIG. 5.
Figure 7:
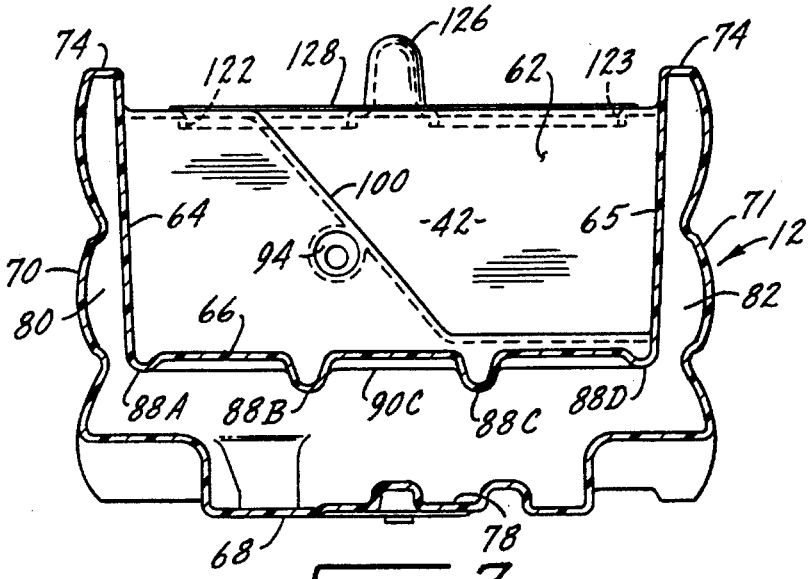
FIG. 7 is a section taken along line 7—7 of FIG. 6.

Looking now at some of the details of the walls defining the battery compartment, the interior bottom wall 66 has a series of longitudinal stiffening ribs or depressions 88A–88D. These ribs intersect with lateral ribs 90A–90C. At the intersections of ribs 88B,C with rib 90B there are pedestals 92, 93 which extend to the exterior bottom wall as best seen in FIG. 6. Together the ribs 88, 90 and pedestals 92, 93 provide sufficient strength to the interior bottom wall 66 to allow it to support the heavy weight of the batteries 44. Other reinforcing means for the battery compartment include pipes 94 and 95 which extend between the interior and exterior walls at the front and rear, respectively. Pipe 95 joins a depression 96 in the rear interior wall 63 and opens into a space between baffles in a bypass wall 110. Pipe 95 provides a passage for electrical cables. Interior side wall 64 has hinge mounting pads 98 (FIG. 6) for receiving the hinges that join lid 14 to the recovery tank 12. Front interiorwall 62 has a ramp 100 with a built-in recess for a lid support bracket (not shown). The lid support bracket is used to prop up the lid when it is open.

Figure 4:
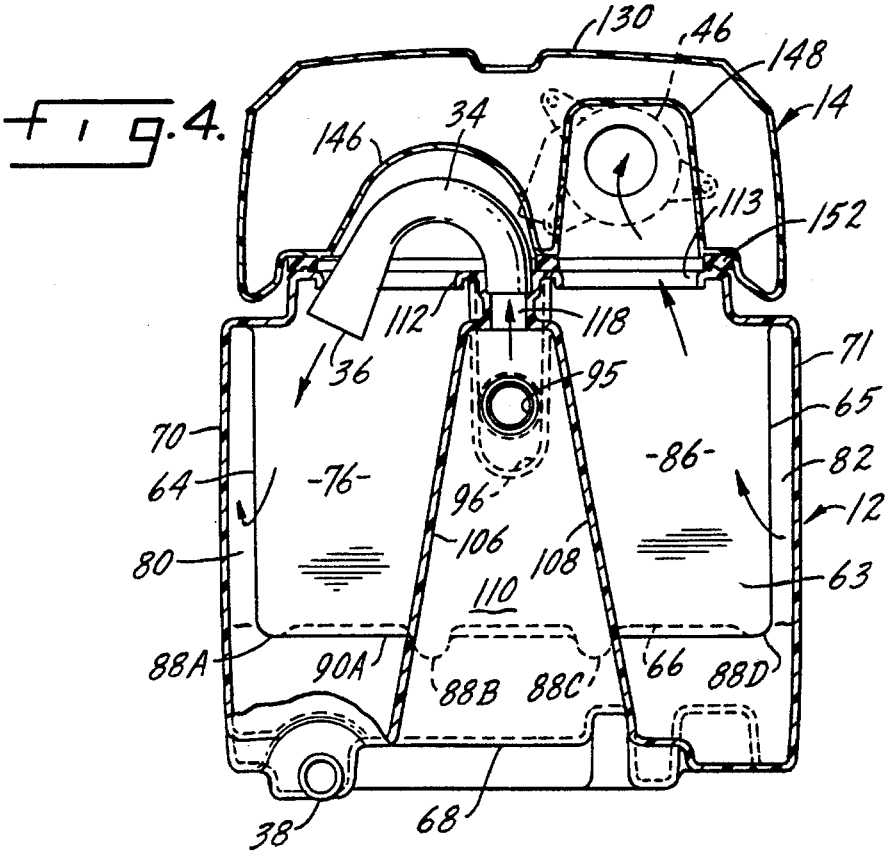
FIG. 4 is a section through the inlet and exit chambers of the recovery tank and lid, looking toward the front of the scrubber.
Figure 5:
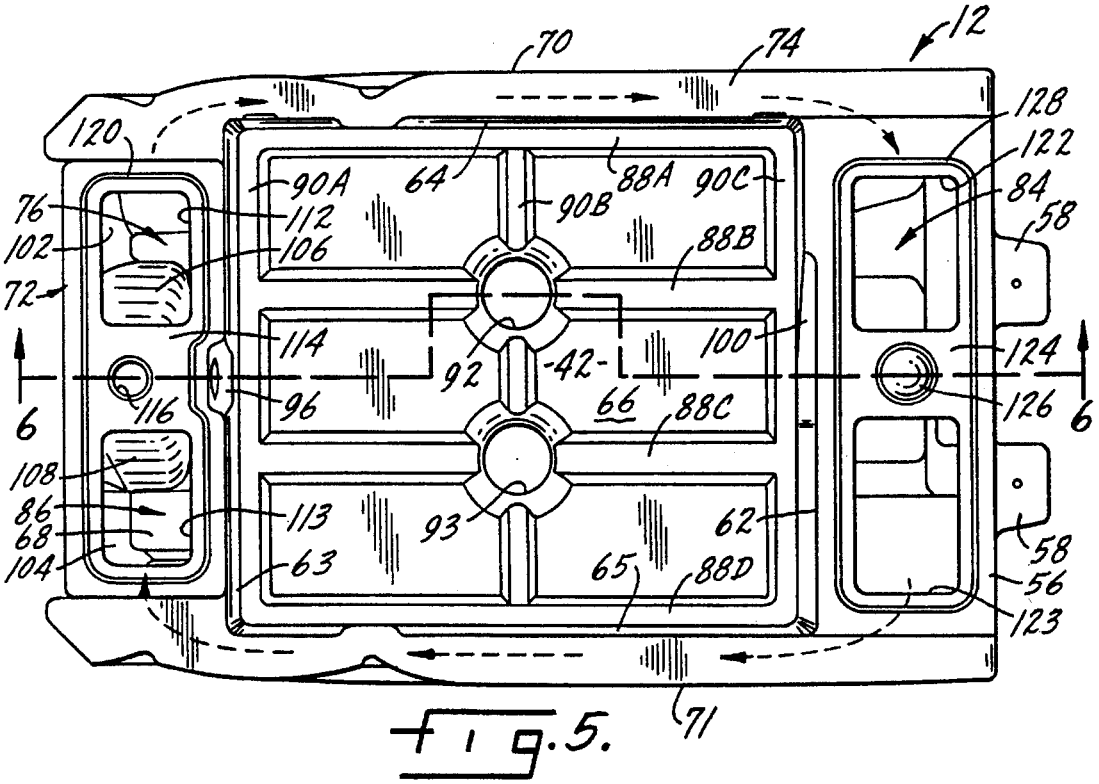
FIG. 5 is a top plan view of the recovery tank.

Consideration will now be given to the rear section 72 of the recovery tank, which is complicated by the fact that instead of having just one large chamber, the rear section defines the inlet and exit chambers 76, 86 which are joined by the bypass 87. The inlet, exit and bypass chambers have in common the outer surface of interior rear wall 63 and the exterior bottom wall 68, as can be seen in FIG. 4. The inlet and exit chambers are further defined by one of the left and right outside wall 70, 71which merge around a corner into a pair of exterior rear walls 102, 104. Toward the centerline of the recovery tank, the rear walls 102, 104 (and the inlet and exit chambers) are bounded by angled baffles or diaphragms 106 and 108. The baffles extend forwardly from the rear walls 102, 104 to a bypass wall 110 and generally from the top wall 74 to the exterior bottom wall 68. The bypass wall 110 and interior rear wall 63 define the passage 87 as best seen in FIG. 6. Thus, another way of looking at the rear section 72 is that the baffles 106, 108 and bypass wall 110 form a depression or indentation in what would otherwise be a single, large rear chamber. The indentation almost, but not entirely, divides that rear chamber into the separate inlet and exit chambers. As it is, the indentation stops short of the interior rear wall 63 leaving passage 87 to connect chambers 76 and 86.

Turning now to the details of the top wall 74, it includes an upraised rear portion having openings 112, 113 which provide access to the inlet and exit chambers. The openings are separated by a double-walled web 114 which has a socket 116 for receiving a union 118 (FIGS. 2 and 4). The union joins the squeegee hose 32 to the inlet duct 34. An upraised sealing bead 120 surrounds the openings. At the front of the scrubber, the top wall has a depressed portion above the front chamber 84. Two access openings 122, 123 are separated by a web 124. A locating peg 126 extends from the top surface of the web 124. The peg fits into a socket in the lid as will be described below. A sealing bead 128 similar to bead 120 surrounds openings 122, 123.

Having fully described the recovery tank 12, attention can now be focused on the lid 14, details of which are shown in FIGS. 8–16. Generally speaking the lid has a top wall 130 sloping into side walls 132, 133 and a forward nose portion 134, a back wall 135, all joining a bottom wall 136. These walls form a generally hollow structure having a plurality of cavities or compartments therein, including a solution tank 138, a fan compartment 140 and extensions 142, 144 of the inlet and exit chambers. The extensions 142, 144 are aligned with the openings 112, 113, respectively, of the recovery tank, as seen in FIG. 4, and thus provide extensions or enlargements of the inlet and exit chambers 76 and 86, respectively.

Figures 8, 9, 10:
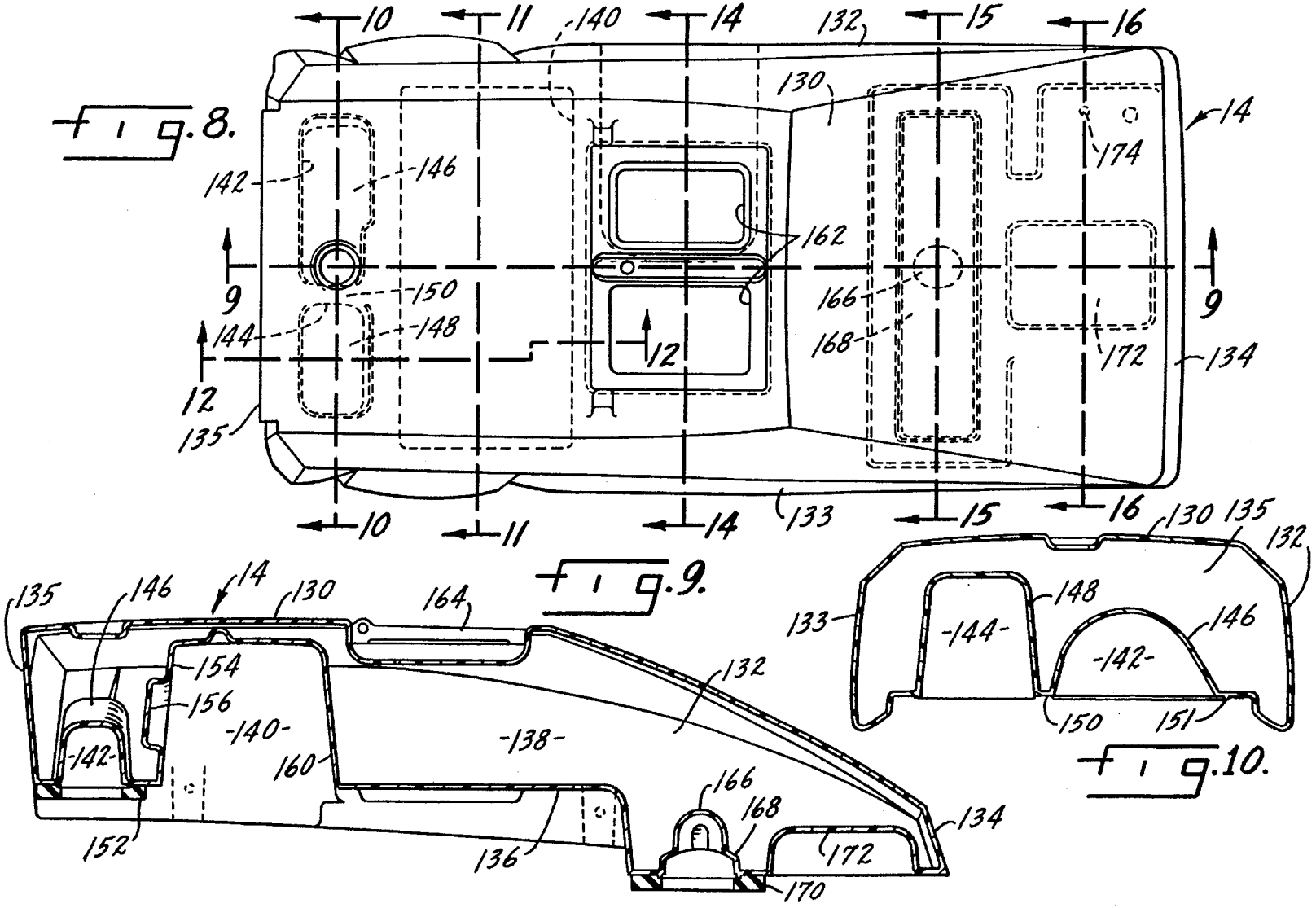
FIG. 8 is top plan view of the lid.
FIG. 9 is a section taken along line 9—9 of FIG. 8.
FIG. 10 is a section taken along line 10—10 of FIG. 8.

In FIG. 10 a dome-shaped enclosure 146 defines the inlet chamber extension 142. The enclosure 146 accommodates the duct 34 as seen in FIG. 4. A five-sided enclosure 148 defines the exit chamber extension 144. Enclosures 146, 148 merge into rib 150. A seal retaining bead 151 is shown in FIG. 13 at the lower edge of the extension chambers. It retains a flexible gasket 152 (FIGS. 4, 9 and 13) that surrounds the enclosures 146, 148. The gasket 152 is arranged to engage the bead 151 to form an air and water-tight seal between the lid and recovery tank in the area of the chambers 76, 86, 142 and 144.

FIGS. 9, 11 and 12 show the fan compartment 140. The rear boundary of the compartment is defined by a fan mounting wall 154 which has a key-shaped depression 156 in which the fan 46 is mounted. There is room in the compartment for an optional second fan, although only one is shown. An opening 158 provides communication between the fan 46 and the exit chamber extension 144. A partition 160 separates the fan compartment 140 from the solution tank 138. As shown in FIGS. 8 and 14 the solution tank has access openings 162 formed in the top wall 130. A hinged cover 164 closes the openings when the cover is folded down. FIG. 15 shows a socket 166 formed in a ledge 168 extending transversely along the bottom wall 136. Socket 166 receives the locating peg 126 on the recovery tank to maintain alignment between the lid and recovery tank. A flexible gasket 170 (FIG. 9) surrounds the underside of the ledge 168 and engages the bead 128 on the front portion of the recovery tank to seal the openings 122, 123. The nose of the lid has an indentation 172 which provides clearance for some of the apparatus mounted in front of the recovery tank, such as a brush lift actuator. A nipple 174 (FIG. 16) accommodates a hose for conveying cleaning solution from the tank to the scrub head.

In terms of the air flow through the scrubber body, the operation of the invention is as follows. The vacuum fan 46 draws air from the exit chamber extension 144 through opening 158 and exhausts it into the fan compartment 140. Compartment 140 is not sealed to the recovery tank so air can vent to atmosphere between the lid and recovery tank. The sub-atmospheric pressure created by the fan draws air and soiled cleaning solution through the squeegee 30, hose 32, duct 34 and into the inlet chamber 76. Most of the air then flows around the battery compartment through left side chamber 80, front chamber 84, right side chamber 82 and exit chamber 86. This air flow path is indicated by the arrows in FIGS. 4 and 5. This circuitous air flow path will result in settling of mist and controlling of foam as described above.

Some of the air bypasses the described path by flowing from inlet chamber 76 through passage 87 to exit chamber 86. When the water level in the recovery tank is below interior bottom wall 66 there can also be air flowing through the bottom chamber 78. This path will be blocked when the recovered liquid fills the bottom chamber but the limited passageway 87 will continue to provide a bypass for a portion of the air.

While a preferred form of the invention has been shown and described, it will be realized that alterations and modifications may be made thereto without departing from the scope of the following claims. For example, the limited air passageway or bypass 87 would not be required if the two side walls had a larger volume so the air velocity through them was slower. In the illustrated embodiment a narrow machine was desired so the side walls are narrow also. But if a wider machine were acceptable, the bypass could be deleted.

I claim:

1. In a surface scrubbing machine comprising a body, wheels rotatably affixed to said body, at least one battery centrally located within the body for providing power to operate the machine, a solution tank on the body for containing scrubbing solution, means on the body for conveying said scrubbing solution from said solution tank to a surface to be scrubbed, means on the body for working the solution on the surface, a vacuum squeegee on the body for recovering said solution from the scrubbed surface, a recovery tank located within said body for containing scrubbing solution after it has been recovered from the scrubbed surface, duct means for conveying said recovered solution from said vacuum squeegee to said recovery tank, a vacuum fan for withdrawing air from said recovery tank, the recovery tank having connected chambers in front of, to the rear of and at both sides of said at least one battery, two of said chambers being separated by a partial partition, said vacuum fan and said duct means being located with respect to the two chambers of the recovery tank separated by the partial partition such that air which is withdrawn from said recovery tank by said vacuum fan will be replaced by air which is supplied by said duct means, and at least a portion of said replacement air will move in a path through the connected chambers of the recovery tank around at least three sides of the at least one battery in the course of traveling from the duct means to the vacuum fan.

2. The surface scrubbing machine of claim 1 in which the recovery tank chambers in front of and to the rear of the at least one battery are larger than the recovery tank chambers at the sides of the at least one battery and serve as expansion chambers for assisting in the control of foam on the scrubbing solution recovered from the surface being scrubbed.

3. The surface scrubbing machine of claim 1 in which the partial partition separating the two recovery tank chambers provides a limited air passageway between the two chambers through which at least a portion of the airflow moving from the duct means to the vacuum fan may be bypassed without traveling around the at least one battery.

4. The surface scrubbing machine of claim 1 in which a removable lid is fitted above the recovery tank, said removable lid containing the solution tank such that an essentially constant fore and aft center of gravity is maintained as the solution tank empties and the recovery tank fills during normal operation.

5. The surface scrubbing machine of claim 1 in which a removable lid is fitted above the recovery tank, said removable lid containing the vacuum fan, an inlet of said vacuum fan being in fluid connection with said recovery tank and an outlet of said vacuum fan exhausting to atmosphere.

6. The surface scrubbing machine of claim 5 in which the removable lid is fitted with gaskets in the areas covering the recovery tank chambers in front of and to the rear of the at least one battery.

7. The surface scrubbing machine of claim 6 in which the front and rear recovery tank chambers are open to atmosphere when the removable lid is raised.

8. In a surface scrubbing machine of the walk-behind type comprising a body, a solution tank on the body for containing scrubbing solution, means on the body for conveying the scrubbing solution from the solution tank to a surface to be scrubbed, means on the body for working the solution on the surface, a vacuum squeegee on the body for recovering soiled solution from the scrubbed surface, a recovery tank located within the body for containing scrubbing solution after it has been recovered from the scrubbed surface, duct means for conveying the recovered solution from the vacuum squeegee to the recovery tank, and a vacuum fan for withdrawing air from the recovery tank, the improvement comprising the recovery tank having an inlet chamber in fluid communication with the duct means, an exit chamber in fluid communication with the vacuum fan, and at least one intermediate chamber between the inlet and exit chambers and in fluid communication with each of them, the intermediate chamber being at the front of the body and the inlet and exit chambers being at the rear of the body, with side chambers connecting the intermediate chamber to the inlet and exit chambers, the inlet and exit chambers being partially separated from one another by baffles which provide a bypass connecting the inlet and exit chambers to permit at least a portion of the fluid flow to bypass the intermediate chamber.

9. In a walk-behind surface scrubbing machine of the type having a body including a solution tank for containing scrubbing solution, means on the body for conveying the scrubbing solution from the solution tank to a surface to be scrubbed, means on the body for working the solution on the surface, and a vacuum fan on the body in communication with a vacuum squeegee on the body for recovering soiled solution from the scrubbed surface the improvement comprising a mist and foam controlling solution recovery tank formed in the body, the recovery tank comprising a plurality of chambers including a first expansion chamber at a rear of the body, a second expansion chamber located at a front of the body, and at least one connecting chamber providing fluid communication between the expansion chambers, a lid pivotally attached to the solution recovery tank, the vacuum fan being mounted in the lid and being located so as to circulate fluid from the first expansion chamber through the at least one connecting chamber to the second expansion chamber.

10. The surface scrubbing machine of claim 9 wherein the first expansion chamber is partially divided by baffles into an inlet chamber in communication with the vacuum squeegee and an exit chamber in communication with the vacuum fan.

11. The surface scrubbing machine of claim 10 wherein a first connecting chamber is intermediate the inlet chamber and the second expansion chamber and a second connecting chamber is intermediate the second expansion chamber and the exit chamber.

12. The surface scrubbing machine of claim 10 wherein the baffles define a bypass connecting the inlet chamber to the exit chamber, the bypass being sized such that a minor portion of the fluid flow can go directly to the exit chamber from the inlet chamber.

13. The surface scrubbing machine of claim 9 wherein the first expansion chamber is partially divided by baffles into an inlet chamber in communication with the vacuum squeegee and an exit chamber in communication with the vacuum fan, the inlet and exit chambers being at least partially defined by the lid.

* * * * *